US011259573B2

(12) United States Patent
Qiu

(10) Patent No.: US 11,259,573 B2
(45) Date of Patent: Mar. 1, 2022

(54) AUTOMATIC MANUAL BATTERY ASSEMBLY AND ELECTRONIC CIGARETTE THEREOF

(71) Applicant: CHANGZHOU JWEI INTELLIGENT TECHNOLOGY CO., LTD., Jiangsu (CN)

(72) Inventor: Weihua Qiu, Jiangsu (CN)

(73) Assignee: CHANGZHOU JWEI INTELLIGENT TECHNOLOGY CO., LTD., Jiangsu (CN)

( * ) Notice: Subject to any disclaimer, the term of this patent is extended or adjusted under 35 U.S.C. 154(b) by 477 days.

(21) Appl. No.: 16/288,640

(22) Filed: Feb. 28, 2019

(65) Prior Publication Data

US 2019/0191771 A1 Jun. 27, 2019

Related U.S. Application Data

(63) Continuation of application No. PCT/CN2017/099162, filed on Aug. 25, 2017.

(30) Foreign Application Priority Data

Aug. 29, 2016 (CN) ..... 201620974643.0

(51) Int. Cl.
*A24F 40/50* (2020.01)
*A24F 40/40* (2020.01)
*A24F 40/60* (2020.01)

(52) U.S. Cl.
CPC ..... *A24F 40/50* (2020.01); *A24F 40/40* (2020.01); *A24F 40/60* (2020.01)

(58) Field of Classification Search
CPC ..... A24F 47/008; A24F 47/40; A24F 47/50; A24F 47/60
See application file for complete search history.

(56) References Cited

U.S. PATENT DOCUMENTS 10,298,225 B1 * 5/2019 Most ..... H05B 3/06
2013/0319439 A1 12/2013 Gorelick et al.
(Continued)

FOREIGN PATENT DOCUMENTS

CN 203482902 U 3/2014
CN 204560957 U 8/2015
(Continued)

*Primary Examiner* — Marcus E Harcum
(74) *Attorney, Agent, or Firm* — Novick, Kim & Lee, PLLC; Allen Xue

(57) ABSTRACT

An automatic manual electronic cigarette includes a battery assembly, an atomizing assembly, a manual switch assembly, an automatic switch assembly and an automatic manual shift assembly. The automatic manual shift assembly includes a shift key and a control board. The control board has a manual control contact and an automatic control contact. When the shift key is electrically connected to the manual control contact, the battery assembly is controlled by the manual switch assembly to supply power to the atomizing assembly; when the switch key is electrically connected to the automatic control contact, the battery assembly is controlled by the automatic switch assembly to supply power to the atomizing assembly. As such, the automatic manual electronic cigarette integrates two functions of manual control and automatic control.

20 Claims, 8 Drawing Sheets

(56) References Cited

U.S. PATENT DOCUMENTS

| | | | | |
|---|---|---|---|---|
| 2013/0319440 | A1* | 12/2013 | Capuano | A61M 15/06 131/329 |
| 2014/0270727 | A1* | 9/2014 | Ampolini | A24F 40/50 392/387 |
| 2014/0334804 | A1* | 11/2014 | Choi | A24F 40/60 392/404 |
| 2014/0339213 | A1* | 11/2014 | Bao | A61M 15/06 219/209 |
| 2015/0173124 | A1* | 6/2015 | Qiu | G06F 13/387 131/328 |
| 2016/0366946 | A1* | 12/2016 | Murison | B67D 7/02 |
| 2017/0049151 | A1* | 2/2017 | Xue | H05B 1/0244 |
| 2017/0238596 | A1* | 8/2017 | Matsumoto | A24F 40/50 |
| 2017/0347704 | A1* | 12/2017 | Oishi | A24F 40/00 |
| 2018/0035714 | A1* | 2/2018 | Sur | A24F 40/46 |
| 2018/0055091 | A1* | 3/2018 | Trzecieski | A61M 15/0023 |
| 2021/0022403 | A1* | 1/2021 | Korus | A61M 15/06 |

FOREIGN PATENT DOCUMENTS

| | | | |
|---|---|---|---|
| CN | 204653789 | U | 9/2015 |
| CN | 205199822 | U | 5/2016 |
| CN | 206005954 | U | 3/2017 |

* cited by examiner

AUTOMATIC MANUAL BATTERY ASSEMBLY AND ELECTRONIC CIGARETTE THEREOF

CROSS-REFERENCE TO RELATED APPLICATIONS

This application is a continuation in part of International Patent Application No. PCT/CN2017/099162, filed on Aug. 25, 2017, entitled "electronic cigarette integrating manual and automatic lighting functions", which claims priority to Chinese Patent Application No. 201620974643.0, filed on Aug. 29, 2016. All of the aforementioned patent applications are hereby incorporated by reference in their entireties.

FIELD

The present disclosure relates to the technical field of electronic cigarette, in particular to a battery assembly capable of automatic as well as manual operations and electronic cigarette thereof.

BACKGROUND

The electronic cigarette is an electronic product that imitates cigarettes. The atomizing assembly of the electronic cigarette heats the smoke liquid in the cartridge to generate smoke, which can be drawn by the user from the cigarette holder, thereby achieving the purpose of simulating smoking.

SUMMARY

The present disclosure provides an automatic manual battery assembly and electronic cigarette thereof.

An automatic manual electronic cigarette includes a battery assembly and an atomizing assembly, the battery assembly is configured to supply power to the atomizing assembly, the automatic manual electronic cigarette further includes a manual switch assembly, an automatic switch assembly and an automatic manual shift assembly, the automatic manual shift assembly includes a shift key and a control board, the control board is provided with a manual control contact and an automatic control contact, when the shift key is electrically connected to the manual control contact, the battery assembly is controlled by the manual switch assembly to supply power to the atomizing assembly, when the switch key is electrically connected to the automatic control contact, the battery assembly is controlled by the automatic switch assembly to supply power to the atomizing assembly.

In one embodiment, the switching key is a rotatable arm, the manual control contact and the automatic control contact are respectively provided with one or more, and are spaced apart in the circumferential direction on the control board, the rotatable arm is alternately electrically connected to the manual control contact and the automatic control contact by rotating itself.

In one embodiment, the rotatable arm is provided with a concave-convex portion that rotates together with the rotatable arm, the rotatable arm further includes a flexible mechanism having an end abuts against the surface of the concave-convex portion, the surface of the concave-convex portion is provided with a plurality of concave positions and a plurality of convex positions, the concave positions are spaced from the convex positions, when the rotatable arm is rotationally switched, the end of the flexible mechanism slides along the surface of the concave-convex portion, when the flexible mechanism slides from the concave position through its immediately adjacent convex position to its spaced apart concave position, the rotatable arm realizes switching between the adjacent manual control contact and the automatic control contact.

In one embodiment, the automatic manual electronic cigarette further includes a mounting seat for positioning the rotatable arm and the control board.

In one embodiment, the rotatable arm includes a rotating wheel and an arm portion, one end of the wheel portion is detachably connected to one end of the arm hand portion, the opposite end of the arm portion is adjacent to the control board, the other end of the rotating wheel is away from the control board.

In one embodiment, the concave-convex portion is provided on the outer circumference of the wheel portion, a spring hole is disposed on the mounting seat at a position facing the concave-convex portion, the flexible mechanism includes a spring and a steel ball, the spring is disposed in the spring hole, the steel ball is disposed between the spring and the concave-convex portion, and abuts against a surface of the concave-convex portion by the thrust of the spring.

In one embodiment, the battery assembly further includes an adjustment ring, the adjusting ring is connected to one end of the rotating wheel portion, the rotating wheel portion and the arm portion are rotated together by twisting the adjusting ring.

In one embodiment, the battery assembly further includes a housing, the atomizing assembly is detachably disposed at an upper end of the outer casing, the automatic switch assembly, the manual switch assembly, the battery assembly and the mounting seat are sequentially disposed in the outer casing from top to bottom In one embodiment, the automatic switch assembly is a pressure sensor.

In one embodiment, the manual switch assembly includes a switch base and an on-off key disposed on the switch base, the housing is provided with an opening corresponding to the on-off key, the on-off key extends to the outside of the outer casing through the opening.

A automatic manual battery assembly for an electronic cigarette, the electronic cigarette comprising a battery assembly and an atomizer assembly, the battery assembly is configured to supply power to the atomizing assembly, the automatic manual battery assembly further includes a manual switch assembly, an automatic switch assembly and an automatic manual shift assembly, the automatic manual shift assembly includes a shift key and a control board, the control board is provided with a manual control contact and an automatic control contact, when the shift key is electrically connected to the manual control contact, the battery assembly is controlled by the manual switch assembly to supply power to the atomizing assembly, when the switch key is electrically connected to the automatic control contact, the battery assembly is controlled by the automatic switch assembly to supply power to the atomizing assembly.

In one embodiment, the switching key is a rotatable arm, the manual control contact and the automatic control contact are respectively provided with one or more, and are spaced apart in the circumferential direction on the control board, the rotatable arm is alternately electrically connected to the manual control contact and the automatic control contact by rotating itself.

In one embodiment, the rotatable arm is provided with a concave-convex portion that rotates together with the rotatable arm, the rotatable arm further includes a flexible mechanism having an end abuts against the surface of the concave-convex portion, the surface of the concave-convex portion is provided with a plurality of concave positions and a plurality of convex positions, the concave positions are spaced from the convex positions, when the rotatable arm is rotationally switched, the end of the flexible mechanism slides along the surface of the concave-convex portion, when the flexible mechanism slides from the concave position through its immediately adjacent convex position to its spaced apart concave position, the rotatable arm realizes switching between the adjacent manual control contact and the automatic control contact.

In one embodiment, the automatic manual electronic cigarette further includes a mounting seat for positioning the rotatable arm and the control board.

In one embodiment, the rotatable arm includes a rotating wheel and an arm portion, one end of the wheel portion is detachably connected to one end of the arm hand portion, the opposite end of the arm portion is adjacent to the control board, the other end of the rotating wheel is away from the control board.

In one embodiment, the concave-convex portion is provided on the outer circumference of the wheel portion, a spring hole is disposed on the mounting seat at a position facing the concave-convex portion, the flexible mechanism includes a spring and a steel ball, the spring is disposed in the spring hole, the steel ball is disposed between the spring and the concave-convex portion, and abuts against a surface of the concave-convex portion by the thrust of the spring.

In one embodiment, the battery assembly further includes an adjustment ring, the adjusting ring is connected to one end of the rotating wheel portion, the rotating wheel portion and the arm portion are rotated together by twisting the adjusting ring.

In one embodiment, battery assembly further includes a housing, the atomizing assembly is detachably disposed at an upper end of the outer casing, the automatic switch assembly, the manual switch assembly, the battery assembly and the mounting seat are sequentially disposed in the outer casing from top to bottom In one embodiment, the automatic switch assembly is a pressure sensor.

In one embodiment, the manual switch assembly includes a switch base and an on-off key disposed on the switch base, the housing is provided with an opening corresponding to the on-off key, the on-off key extends to the outside of the outer casing through the opening.

An electronic cigarette includes any one of the above battery assemblies.

The beneficial effects of the device are:

In the disclosure, the battery of the battery assembly powers the atomizing assembly. The sensor is electrically connected to the control circuit of the control board to automatically control the opening and closing of the circuit between the battery and the atomizing assembly, the switch key is configured to manually control the opening and closing of the circuit between the battery and the atomizing assembly. The shift key is provided with at least a first position and a second position that are displaceable. When the shift key is displaced to the first position, the sensor is prevented from sensing the specific parameter, the opening key can be mechanically displaced and controlled to control the opening and closing of the circuit between the battery and the atomizing assembly. When the shift key is displaced to the second position, the switch key can be made mechanically displaceable, the sensor can sense the specific parameter and control the opening and closing of the circuit between the atomizing assembly through the control board.

The electronic cigarette of the present disclosure uses the shift key to alternately switch the applicable control mode of the electronic cigarette, that is, alternately to switch between manual cigarette lighting and automatic cigarette lighting. Additionally, the switch button uses a mechanical switching method instead of a circuit control or software controlled switching method. Thus, the electronic cigarette of the disclosure realizes the switching between manual cigarette lighting and automatic cigarette lighting.

Figure 1:
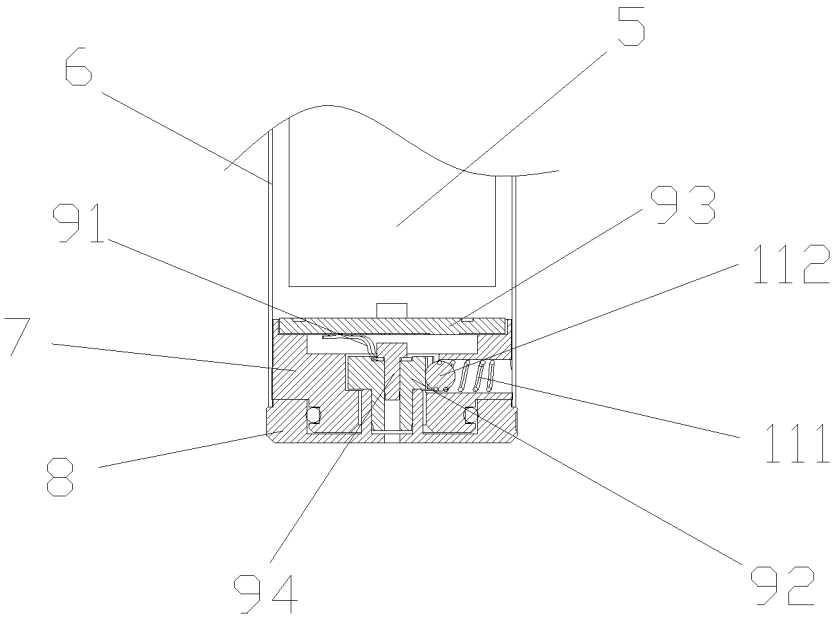
FIG. 1 is a partial cross-sectional view of an automatic manual switching assembly of the automatic manual electronic cigarette of one embodiment of the present disclosure.

The following table list various components and reference numerals thereof.

| | |
|---|---|
| Atomizing assembly 1 | Battery end cover 2 |
| Battery assembly 5 | Housing 6 |
| Automatic manual shift assembly 9 | Arm portion 91 |
| Pin 94 | On-off key 41 |
| Concave position 921 | Convex position 922 |
| Spring 111 | steel ball 112 |
| Air outlet tube 12 | mouthpiece 13 |
| Automatic switch assembly 3 | Manual switch assembly 4 |
| Mounting base 7 | Adjusting ring 8 |
| Wheel portion 92 | Control board 93 |
| Air inlet 21 | Opening 61 |
| Manual control contact 931 | Automatic control contact 932 |
| Flexible mechanism 110 | Atomizer 11 |

DETAILED DESCRIPTION OF PREFERRED EMBODIMENTS

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising," when utilized, means "including, but not necessarily limited to"; it specifically indicates open-ended inclusion or membership in the so-described combination, group, series and the like.

When a feature or element is herein referred to as being "on" another feature or element, it can be directly on the other feature or element or intervening features and/or elements may also be present.

Terminology used herein is for the purpose of describing particular embodiments only and is not intended to be limiting of the disclosure. As used herein, the term "and/or" includes any and all combinations of one or more of the associated listed items and may be abbreviated as "/".

Figure 4:
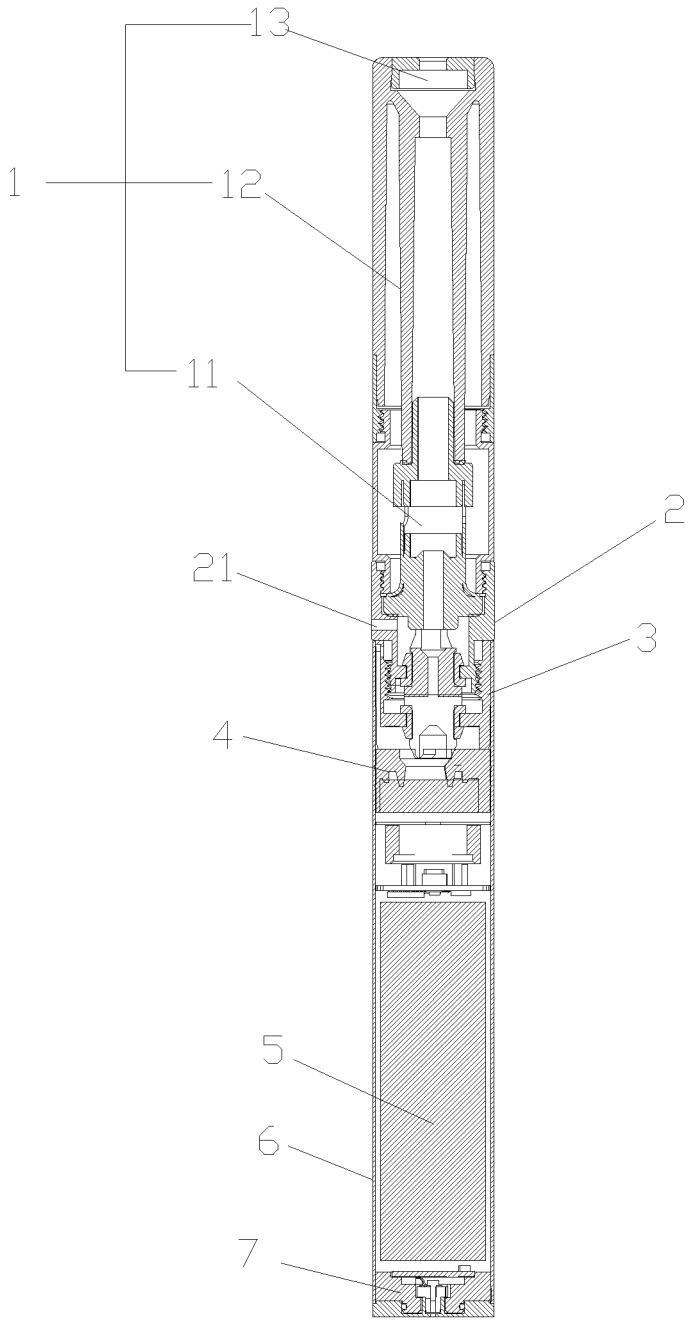
FIG. 4 is a cross-sectional view of the automatic manual electronic cigarette of one embodiment of the present disclosure.
Figure 5:
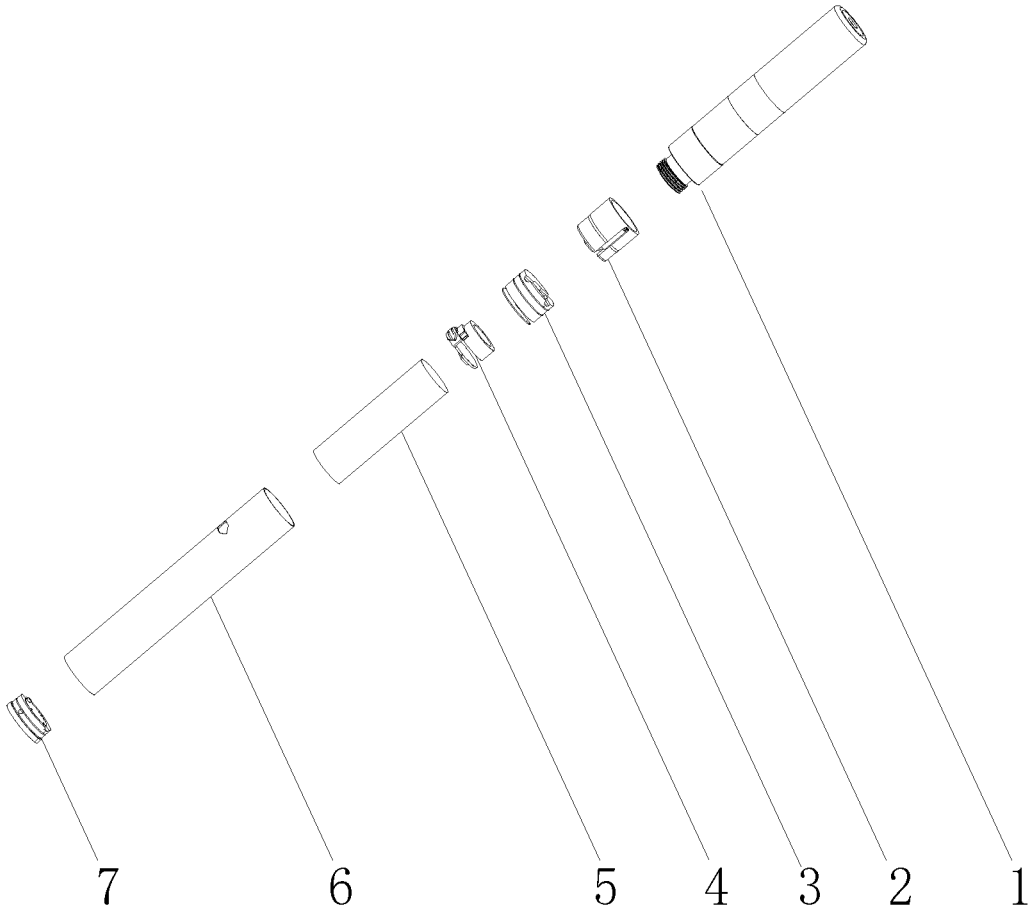
FIG. 5 is an exploded view of the automatic manual electronic cigarette of one embodiment of the present disclosure.
Figure 6:
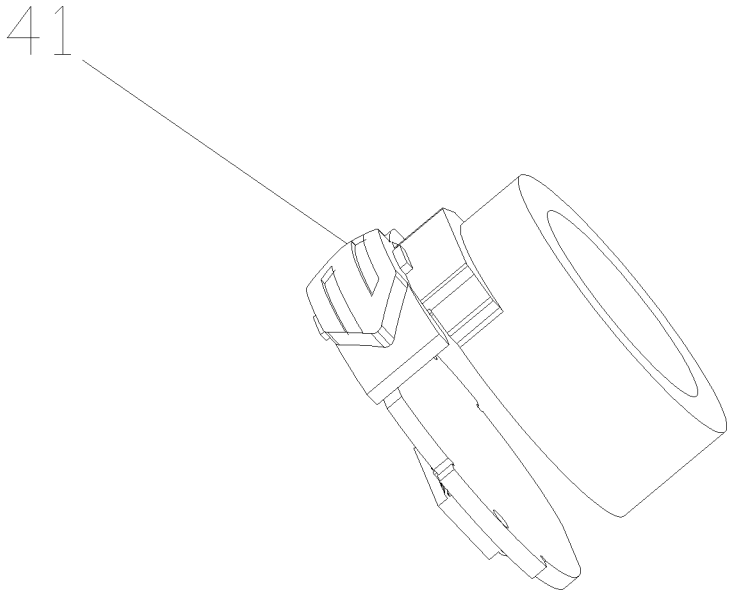
FIG. 6 is a perspective view of an opening key of the automatic manual electronic cigarette of one embodiment of the present disclosure.
Figure 7:
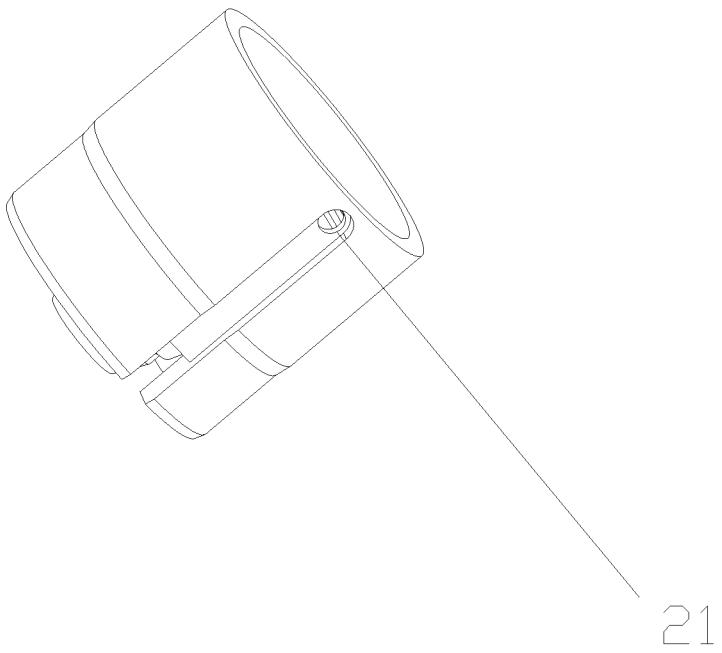
FIG. 7 is a perspective view of a battery end cap of the automatic manual electronic cigarette of one embodiment of the present disclosure.
Figure 8:
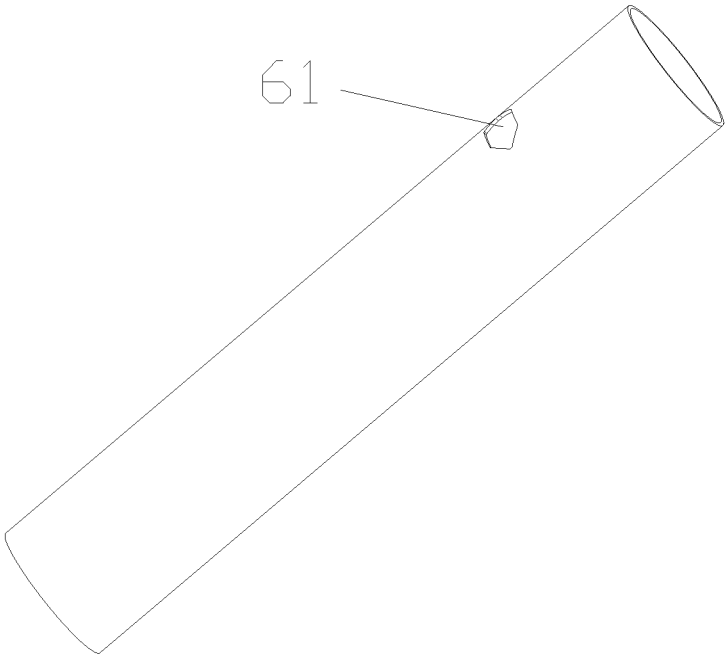
FIG. 8 is a perspective view of the housing of the automatic manual electronic cigarette of one embodiment of the present disclosure.

Referring to FIGS. 4 and 5, the embodiment discloses an automatic manual electronic cigarette, the automatic manual electronic cigarette includes a battery assembly 5 and an atomizing assembly 1, the battery assembly 5 is configured to supply power to the atomizing assembly 1. The automatic manual electronic cigarette further includes a manual switch assembly 4, an automatic switch assembly 3, and an automatic manual shift assembly 9. The automatic manual shift assembly 9 includes a shift key and a control board 93, the control board 93 is provided with a manual control contact 931 and an automatic control contact 932. When the shift key is electrically connected to the manual control contact 931, the battery assembly 5 is controlled by the manual switch assembly 4 to supply power to the atomizing assembly 1. When the switch key is electrically connected to the automatic control contact 932, the battery assembly 5 is controlled by the automatic switch assembly 3 to supply power to the atomizing assembly 1.

The battery assembly 5 supplies power to the atomizing assembly 1. When the atomizing assembly 1 is electrically connected to the battery assembly 5, the atomizing assembly 1 starts working. When the circuit between the atomizing assembly 1 and the battery assembly 5 is opened, the atomizing assembly 1 stops working. In order to realize the control of the opening or closing of the circuit between the battery assembly and the atomizing assembly, the electronic cigarette is provided with two control modes, namely manual control and automatic control, respectively. The two control modes are implemented by the manual switch assembly 4 and the automatic switch assembly 3, respectively. The manual and automatic functions are effective separately, that is, at the same time and in the same state, the electronic cigarette can only be activated by manual or automatic, the manual and automatic functions cannot be effective at the same time. Specifically, the electronic cigarette is provided with the automatic manual shift assembly 9 to realize switching between manual and automatic control modes. The automatic manual shift assembly 9 includes a shift key and a control board 93, the control board 93 is provided with a manual control contact 931 and an automatic control contact 932. When the shift key is electrically connected to the manual control contact 931, the battery assembly 5 is controlled by the manual switch assembly 4 to supply power to the atomizing assembly 1. When the switch key is electrically connected to the automatic control contact 932, the battery assembly 5 is controlled by the automatic switch assembly 3 to supply power to the atomizing assembly 1. Therefore, the automatic manual shift assembly of the electronic cigarette of the present invention realizes switching between the manual and automatic control modes by selecting a circuit.

Figure 2:
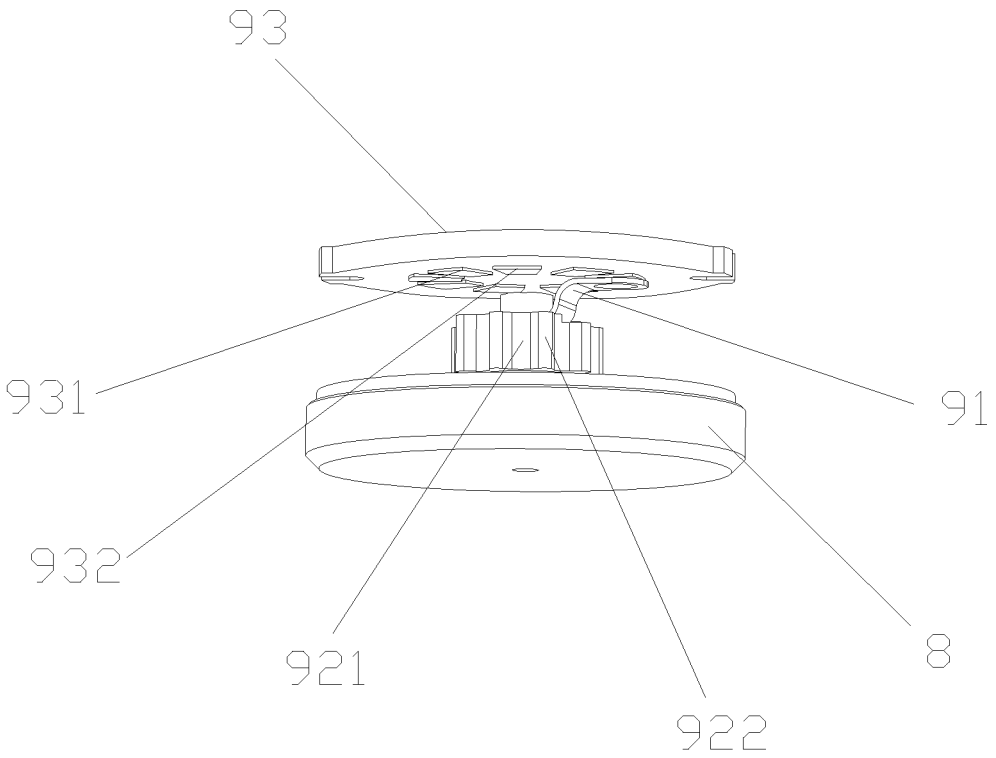
FIG. 2 is a perspective view of the automatic manual switching assembly of the automatic manual electronic cigarette of one embodiment of the present disclosure.

The switching key is configured to the switched connection between the manual control contact 931 and the automatic control contact 932 to realize manual and automatic control switching. As shown in FIGS. 1 and 2, in the embodiment, the switching key is a rotatable arm, the manual control contact 931 and the automatic control contact 932 are respectively provided with one or more, are spaced apart in the circumferential direction on the control board 93. The rotatable arm is alternately electrically connected to the manual control contact 931 and the automatic control contact 932 by rotating itself. It can be understood that, the number of the manual control contacts 931 and the automatic control contacts 932 can be one or more. When the number of the manual control contacts 931 and the automatic control contacts 932 are respectively two or more, the contact adjacent to one of the manual control contacts 931 is an automatic control contact 932, the contact adjacent to one of the automatic control contacts 932 is a manual control contact 931. In this way, regardless of whether the shift key is rotated circumferentially to the left or right, the switching between the manual control and the automatic control can be realized, the operation is convenient. It should be understood that, the use of a rotatable arm for rotational switching is only one embodiment of the present embodiment. It can also be implemented in other ways, such as a lever switch, slide switches.

Figure 3:
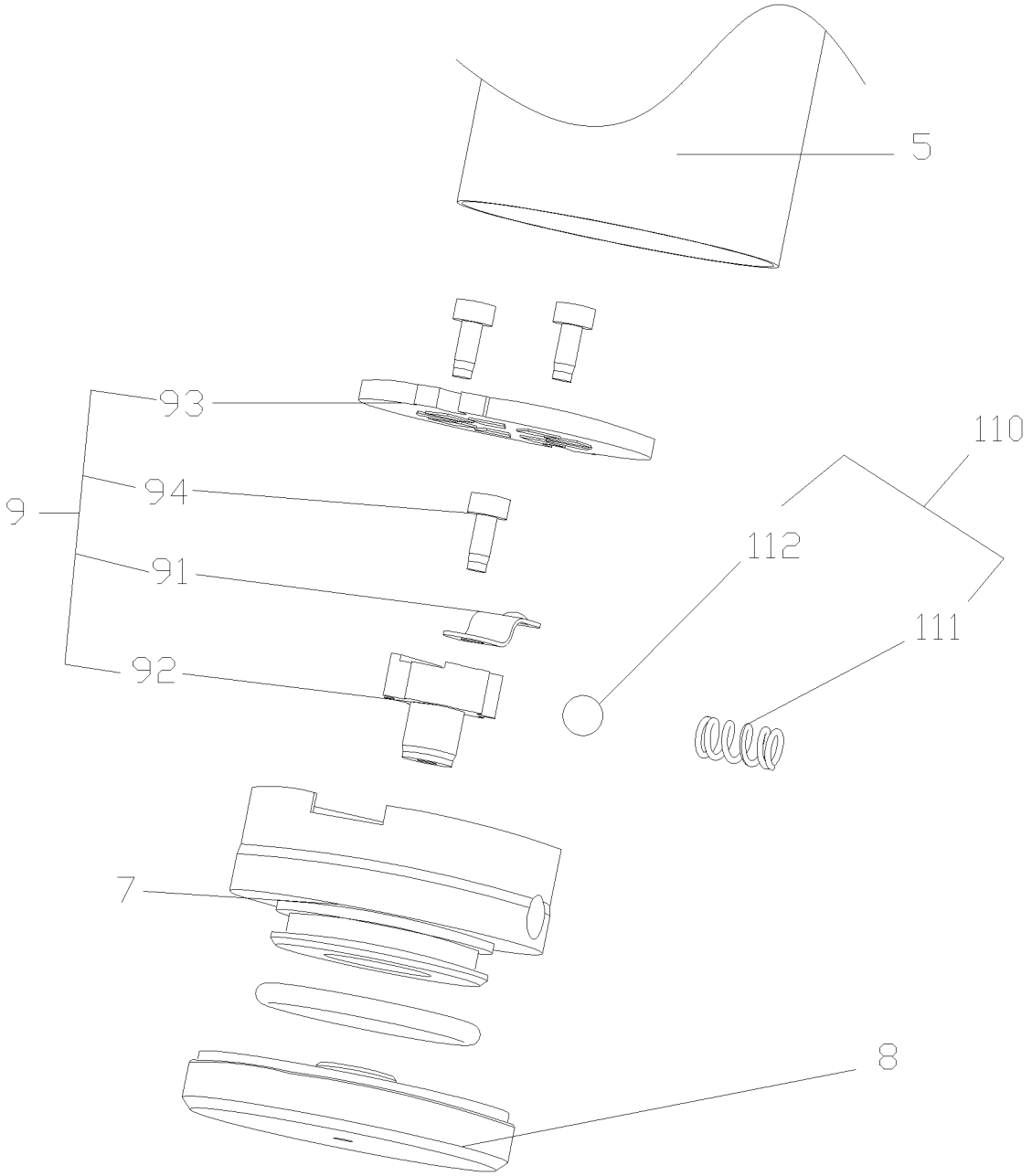
FIG. 3 is an exploded view of the automatic manual switching assembly of the automatic manual electronic cigarette of one embodiment of the present disclosure.

If there is no reminder in place during the rotary switching operation, it is easily to over rotated, or it is difficult to grasp the angle of rotation, so that a reminder function can be further provided by the electronic cigarette. As shown in FIG. 2 and FIG. 3, in one embodiment, the rotatable arm is provided with a concave-convex portion that rotates together with the rotatable arm, the rotatable arm further includes a flexible mechanism 110 having an end abuts against the surface of the concave-convex portion. The surface of the concave-convex portion is provided with a plurality of concave positions 921 and a plurality of convex positions 922. The concave positions 921 are spaced from the convex positions 922. When the rotatable arm is rotationally switched, the end of the flexible mechanism 110 slides along the surface of the concave-convex portion. When the flexible mechanism 110 slides from the concave position 921 through its immediately adjacent convex position 922 to its spaced apart concave position 921, the rotatable arm realizes switching between the adjacent manual control contact 931 and the automatic control contact 932. When the flexible mechanism 110 is from the concave position 921 to the convex position 922, an adjustment hand feeling is formed. When the flexible mechanism 110 is rotated from the convex position 922 to the concave position 921, an impact sound is generated to remind the user that the adjustment is completed.

In order to make the relative position between the rotatable arm and the control board 93 are fixed once mounted after installation, to ensure that the contact between the rotatable arm and the control board 93 is more reliable. In the embodiment, the electronic cigarette further includes a mounting seat 7 for positioning the rotatable arm and the control board 93. The mounting seat 7 serves as a common mounting member of the rotatable arm and the control board 93, so that the relative positions between the rotatable arm and the control board 93 are fixed once mounted after installation, as such, the relative position between the rotatable arm and the control board 93 is fixed.

However, in order to facilitate the disassembly and assembly operation of the rotatable arm in the mounting seat 7. As shown in FIG. 3, the rotatable arm includes two parts, a rotatable wheel portion 92 and an arm portion 91, respectively. The rotatable wheel portion 92 is detachably connected to the arm portion 91. The concave-convex portion is provided on the outer circumference of the wheel portion 92, a spring hole is disposed on the mounting seat 7 at a position facing the concave-convex portion, the flexible mechanism 110 includes a spring 111 and a steel ball 112. The spring 111 is disposed in the spring hole, the steel ball 112 is disposed between the spring 111 and the concave-convex portion, and abuts against a surface of the concave-convex portion by the thrust of the spring 111.

Specifically, the wheel portion 92 is a truncated cone shape having steps up and down, a pin hole is disposed in a middle portion of the wheel portion 92. The arm portion 91 includes an upper plate, a middle slant plate and a lower plate. The middle slant plate is connected between the upper plate and the lower plate. The arm portion 91 is connected to the wheel portion 92 through the lower plate, the arm portion 91 is electrically connected to the control board 93 through the upper plate. The middle slanting plate is inclined to the right at an angle, a protrusion is protruded upward on the upper plate, a mounting hole for mounting and fixing the arm portion 91 and the wheel portion 92 is provided on the lower plate. The lower plate of the arm portion 91 abuts against the upper surface of the wheel portion 92, the pin hole on the wheel portion 92 is aligned with the mounting hole on the arm portion 91, the wheel portion 92 and the arm portion 91 are connected together through a pin extending through the mounting hole a pin hole. In other embodiments, a screw may be instead of the pin 94 to connect the wheel portion 92 with the arm portion 91. The control board 93 is provided with an automatic control contact 932 and a manual control contact 931 on one side facing the arm portion 91. The protrusion of the arm portion 91 abuts against the surface of the automatic control contact 932/manual control contact 931, to achieve automatic control/manual control.

The control panel is provided with four manual control contacts 931 and four automatic control contacts 932. The manual control contact 931 and the automatic control contact 932 are equally disposed on one side of the control board 93 in a circumferential direction. One automatic control contact 932 (manual control contact 931) is interposed between any two manual control contacts 931, and one manual control contact 931 is interposed between any two automatic control contacts 932. The manual control contact 931 and the automatic control contact 932 can be mounted on the control panel through Surface Mounted Technology (SMT).

As shown in FIG. 3, the mounting base 7 is provided with a cavity therein, three steps are arranged in the cavity. The rotatable arm is inserted into the lower half of the cavity, and the step of the wheel portion 92 abuts against the first step below. The arm portion 91 is located between the second step and the third step, the control board 93 abuts against the third step.

As shown in FIG. 1, the battery assembly 5 further includes an adjustment ring 8, the adjusting ring 8 is connected to one end of the rotatable wheel portion 92, the rotatable wheel portion 92 and the arm portion 91 are rotated by twisting the adjusting ring 8. The adjusting ring 8 is provided at the end of the wheel portion 92, to solve the problem that the rotatable wheel portion 92 cannot be grasped or that the wheel portion 92 is too small to be easily grasped, so that the rotation is convenient. Rotating the adjusting ring 8, the adjusting ring 8 drives the rotatable arm to rotate, so that the protrusion of the arm portion 91 is switched connection between the automatic control contact 932 and the manual control contact 931, thereby realizing switching between automatic control and manual control.

As shown in FIGS. 4-8, the battery assembly 5 further includes a housing 6, the atomizing assembly 1 is detachably disposed at an upper end of the housing 6. The atomizing assembly 1 includes an atomizer 11, an air outlet tube 12 and a mouthpiece 13, the air outlet tube 12 is connected between the atomizer 11 and the mouthpiece 13. The atomizer 11 is connected to the battery end cover 2 of the housing 6, the battery end cover 2 is provided with an air inlet 21 for outside air entering the atomizer 11. The automatic switch assembly 3, the manual switch assembly 4, the battery assembly 5 and the mounting seat 7 are sequentially disposed in the housing 6 from top to bottom, the adjusting ring 8 covers the lower end of the housing 6. In one embodiment, the automatic switch assembly 3 is a pressure sensor. The atomizer 11 includes an intake passage in communication with the air inlet 21, the outside air enters the atomizer 11 through the intake port and the intake passage sequentially. The air passage of the pressure sensing sensor is in communication with the intake passage, under the suction of the user, the air in the air passage of the pressure sensing sensor is taken away to form a negative pressure. The manual switch assembly 4 includes a switch base and an opening key 41 disposed on the switch base. The housing 6 is provided with an opening 61 corresponding to the opening key 41, the opening key 41 extends to the outside of the housing 6 through the opening 61.

In summary, the automatic manual electronic cigarette of the disclosure integrates two functions of manual control and automatic control.

The above-mentioned embodiments merely represent several implementations of the present application, and the descriptions thereof are more specific and detailed, but they shall not be understood as a limitation on the scope of the present application. It should be noted that, for those of ordinary skill in the art, variations and improvements may still be made without departing from the concept of the present application, and all of which shall fall into the protection scope of the present application. Therefore, the scope of protection of the present application shall be subject to the appended claims.

What is claimed is:

1. An automatic manual electronic cigarette comprising: an atomizing assembly, a battery assembly configured to supply power to the atomizing assembly; a manual switch assembly; an automatic switch assembly; and an automatic manual shift assembly, wherein the automatic manual shift assembly comprises a shift key and a control board, the control board is provided with one or more manual control contacts and one or more automatic control contacts, when the shift key is electrically connected to one of the one or more manual control contacts, the battery assembly is controlled by the manual switch assembly to supply power to the atomizing assembly, when the shift key is electrically connected to one of the one or more automatic control contacts, the battery assembly is controlled by the automatic switch assembly to supply power to the atomizing assembly.

2. The automatic manual electronic cigarette according to claim 1, wherein the shift key is a rotatable arm, the one or more manual control contacts and the one or more automatic control contacts are spaced apart in a circumferential direction on the control board, and the rotatable arm alternately connects to one of the one or more manual control contact and one of the one or more automatic control contact when in rotation.

3. The automatic manual electronic cigarette according to claim 1, wherein the rotatable arm is provided with a concave-convex portion that rotates together with the rotatable arm, the rotatable arm further comprises a flexible mechanism having an end abutting against a surface of the concave-convex portion, the surface of the concave-convex portion is provided with a plurality of concave positions and a plurality of convex positions, the concave positions are spaced away from the convex positions, when the rotatable arm rotates, the end of the flexible mechanism slides along the surface of the concave-convex portion, and when the flexible mechanism slides from one of the plurality of concave positions through an adjacent convex position to a next concave position, the rotatable arm realizes switching between the adjacent manual control contact and the automatic control contact.

4. The automatic manual electronic cigarette according to claim 3, wherein the automatic manual electronic cigarette further comprises a mounting seat for positioning the rotatable arm and the control board.

5. The automatic manual electronic cigarette according to claim 4, wherein the rotatable arm comprises a rotating wheel portion and an arm portion, a first end of the rotating wheel portion is detachably connected to a first end of the arm portion, a second end of the arm portion is adjacent to the control board, a second end of the rotating wheel portion is positioned away from the control board.

6. The automatic manual electronic cigarette according to claim 5, wherein the concave-convex portion is provided on an outer circumference of the rotating wheel portion, a spring hole is disposed on the mounting seat at a position facing the concave-convex portion, the flexible mechanism comprises a spring and a steel ball, the spring is disposed in the spring hole, the steel ball is disposed between the spring and the concave-convex portion and abuts against a surface of the concave-convex portion under a force exerted by the spring.

7. The automatic manual electronic cigarette according to claim 6, wherein the battery assembly further comprises an adjusting ring connected to the rotating wheel portion, and the rotating wheel portion and the arm portion are rotated together by twisting the adjusting ring.

8. The automatic manual electronic cigarette according to claim 7, wherein battery assembly further comprises a housing, the atomizing assembly is detachably disposed at an upper end of the outer casing, and the automatic switch assembly, the manual switch assembly, the battery assembly and the mounting seat are sequentially disposed in an outer casing from top to bottom.

9. The automatic manual electronic cigarette according to claim 8, wherein the automatic switch assembly is a pressure sensor.

10. The automatic manual electronic cigarette according to claim 8, wherein the manual switch assembly includes a switch base and an on-off key disposed on the switch base, the housing is provided with an opening corresponding to the on-off key, and the on-off key extends outside of the outer casing through the opening.

11. A automatic manual battery assembly for an electronic cigarette, the electronic cigarette comprising: an atomizing assembly, a battery assembly configured to supply power to the atomizing assembly; a manual switch assembly; an automatic switch assembly; and an automatic manual shift assembly, wherein the automatic manual shift assembly comprises a shift key and a control board, the control board is provided with one or more manual control contacts and one or more automatic control contacts, when the shift key is electrically connected to one of the one or more manual control contacts, the battery assembly is controlled by the manual switch assembly to supply power to the atomizing assembly, when the shift key is electrically connected to one of the one or more automatic control contacts, and the battery assembly is controlled by the automatic switch assembly to supply power to the atomizing assembly.

12. The automatic manual battery assembly according to claim 11, wherein the shift key is a rotatable arm, the one or more manual control contacts and the one or more automatic control contacts are spaced apart in a circumferential direction on the control board, and the rotatable arm alternately connects to one of the one or more manual control contact and one of the one or more automatic control contact when in rotation.

13. The automatic manual battery assembly according to claim 12, wherein the rotatable arm is provided with a concave-convex portion that rotates together with the rotatable arm, the rotatable arm further comprises a flexible mechanism having an end abutting against a surface of the concave-convex portion, the surface of the concave-convex portion is provided with a plurality of concave positions and a plurality of convex positions, the concave positions are spaced away from the convex positions, when the rotatable arm rotates, the end of the flexible mechanism slides along the surface of the concave-convex portion, when the flexible mechanism slides from one of the plurality of concave positions through an adjacent convex position to a next concave position, the rotatable arm realizes switching between the adjacent manual control contact and the automatic control contact.

14. The automatic manual battery assembly according to claim 13, wherein the automatic manual electronic cigarette further comprises a mounting seat for positioning the rotatable arm and the control board.

15. The automatic manual battery assembly according to claim 14, wherein the rotatable arm comprises a rotating wheel portion and an arm portion, a first end of the rotating wheel portion is detachably connected to a first end of the arm portion, a second end of the arm portion is adjacent to the control board, and a second end of the rotating wheel portion is positioned away from the control board.

16. The automatic manual battery assembly according to claim 15, wherein the concave-convex portion is provided on an outer circumference of the rotating wheel portion, a spring hole is disposed on the mounting seat at a position facing the concave-convex portion, the flexible mechanism comprises a spring and a steel ball, the spring is disposed in the spring hole, the steel ball is disposed between the spring and the concave-convex portion, and abuts against a surface of the concave-convex portion by under a force exerted by the spring.

17. The automatic manual battery assembly according to claim 16, wherein the battery assembly further comprises an adjusting ring connected to the rotating wheel portion, and the rotating wheel portion and the arm portion are rotated together by twisting the adjusting ring.

18. The automatic manual battery assembly according to claim 17, wherein battery assembly further comprises a housing, the atomizing assembly is detachably disposed at an upper end of the outer casing, and the automatic switch assembly, the manual switch assembly, the battery assembly and the mounting seat are sequentially disposed in an outer casing from top to bottom.

19. The automatic manual battery assembly according to claim 18, wherein the automatic switch assembly is a pressure sensor.

20. The automatic manual battery assembly according to claim 19, wherein the manual switch assembly includes a switch base and an on-off key disposed on the switch base, the housing is provided with an opening corresponding to the on-off key, and the on-off key extends outside of the outer casing through the opening.

* * * * *